US006349758B1

(12) United States Patent
Bell

(10) Patent No.: US 6,349,758 B1
(45) Date of Patent: Feb. 26, 2002

(54) APPARATUS FOR FORMING A POUR HOLE AND MAIN SPRUE IN AN INVESTMENT MOLD FOR LOST WAX CASTING

(76) Inventor: Louis E. Bell, 3302 La Rambla, NW., Albuquergue, NM (US) 87120

( * ) Notice: Subject to any disclaimer, the term of this patent is extended or adjusted under 35 U.S.C. 154(b) by 0 days.

(21) Appl. No.: 09/228,609

(22) Filed: Jan. 12, 1999

Related U.S. Application Data

(60) Provisional application No. 60/071,266, filed on Jan. 13, 1998.

(51) Int. Cl.[7] ..... B22C 7/00

(52) U.S. Cl. ..... 164/235; 164/244; 164/362; 164/397

(58) Field of Search ..... 164/235, 244, 164/362, 397

(56) References Cited

U.S. PATENT DOCUMENTS 3,401,737 A * 9/1968 Rosenfeld ..... 164/244
3,768,544 A * 10/1973 Padeh ..... 164/244
3,939,898 A * 2/1976 Petro et al. ..... 164/244

FOREIGN PATENT DOCUMENTS

JP 55-97840 * 7/1980 ..... 164/244

* cited by examiner

*Primary Examiner*—Kuang Y. Lin
*Assistant Examiner*—I.-H. Lin
(74) *Attorney, Agent, or Firm*—Samuel M. Freund

(57) ABSTRACT

Apparatus for forming a pour hole and main sprue in an investment mold for lost wax casting. A sprue having a flared base, a base member adapted to receive the flared base of the sprue for vertically supporting the sprue, and a flask for containing investment material immersing the sprue, define the casting apparatus of the present invention. The present investment casting sprue apparatus forms a pour hole in the hardened investment material suitable for smoothly introducing liquid metals into the cavity formed by the sprue, thereby reducing the number of casting defects related to turbulent filling. This is accomplished as a result of the flared base of the sprue, which forms a gentle transition into the sprue. The current practice, by contrast, uses a sprue having a cylindrical base which is simply inserted into a hole in a finger or button formed in the supporting base member for the sprue without regard to this smooth transition. The design of the present base member permits ready removal thereof from the hardened investment material without damage to the sprue or to the investment material, thereby reducing the number of inclusion defects in the castings.

4 Claims, 4 Drawing Sheets

PRIOR ART

APPARATUS FOR FORMING A POUR HOLE AND MAIN SPRUE IN AN INVESTMENT MOLD FOR LOST WAX CASTING

This Appln claims benefit of Prov. No. 60/071,266 filed Jan. 13, 1998.

FIELD OF THE INVENTION

The present invention relates generally to lost wax casting of metals and, more particularly, to the design of a sprue and a base for supporting the sprue that significantly reduces splash and spatter which often occur in the molten metal pouring process, and which lead to cold shorts that result in imperfect castings and loss of precious metals.

BACKGROUND OF THE INVENTION

Industries which produce small castings generally do so using a tree which includes a sprue button, a sprue, feed sprues and patterns which are the objects of the castings. The tree is made of a material, such as wax, that can be removed from the mold by burning or chemical dissolution to leave a cavity which is an accurate reproduction of the original tree. The tree is held upright on a sprue base, which base, together with an outer tube, also held upright by the base, forms an open container in which the tree is located such that the tree can be surrounded (invested) by a material called investment, such as a plaster, which hardens after pouring to make a mold by filling the container with the investment through the open end of the container. The container with the tree and the investment is placed in a vacuum in order to remove any air bubbles before the investment sets or hardens. The sprue base is detached from the container after the investment material hardens and the tree is removed by burning it out in a hot oven or by chemical dissolution, leaving a cavity in the mold that may be filled or cast with liquid metal. The entire process is called lost wax casting.

In presently used apparatus the sprue button or pour hole is formed as part of the sprue base which holds the sprue. FIG. 1 hereof, labeled "Prior Art", is a schematic representation of a typical sprue and base apparatus for supporting sprues currently used in the jewelry industry. Shown is horizontally disposed base member, 10, which supports the cylindrical shaft, 12, of sprue, 14, in socket, 16, formed in sprue button, 18. Although the sprue is designed to fit snugly into the cavity, occasionally, a sprue is found floating in the investment slurry, 20, which is poured into container, 22, formed by base member 10 and vertical flask wall, 24. A combination of wear in cavity or socket 16 and air trapped beneath the sprue therein, is thought to be the cause of this occurrence. To reduce the tendency of the sprue to be released from cavity 16, a hot tool is often used to make a seal or junction, 26, between the sprue button 18 and the sprue 14. However, this procedure results in a narrowing of the wax sprue causing turbulent flow to occur when liquid metal is ultimately poured into the cavity formed by the sprue button and the sprue. This restricts the movement of the molten metal into the sprue network, 28, which increases the liquid pool in the sprue button at the end of the pouring process. Additionally, as can be observed from FIG. 1, the shape of sprue button 18 by itself introduces an non-uniform transition between the pour hole and the open end of the sprue. Higher mold temperatures must be employed to compensate for the slower metal flow, and casting defects often occur during the pouring of the molten metal into the cavity. However, the high temperatures involved, the need to maintain an appropriate atmosphere surrounding the melting and pouring zone, and the opacity of the mold itself have prevented visual observation of the actual process.

Molten metal which overflows the pour hole in the mold formed by the base of the sprue is called splash, while unfilled or partially filled patterns are known as cold shorts. It is presently believed by practitioners of the lost wax process that splash is a consequence of too rapid filling of the mold cavity; in fact, the present inventor has determined that splash results from a wave that overflows the pour hole when the end of the poured liquid metal stream enters the liquid pool in the sprue button. Cold shorts are the result of metal having been lost from the pour hole causing a reduction in pressure in the sprue itself and increasing the likelihood that patterns near to the pour hole will not fill completely. Such shorts are localized near to the pour hole. Random cold shorts or cold short fills are identified as patterns on a cast tree which have not completely filled that are randomly disposed on the tree. Such short fills are caused by temperatures which are insufficient to permit the metal to flow such that the mold cavity can completely fill before the metal solidifies. This can be the result of too low a metal temperature and/or too low a mold temperature. It is believed by the present inventor that turbulence in the liquid metal flow in the region of the junction of the feed sprues and the main sprue caused by the transition between the pour hole and the main sprue leaves small metal deposits which further restricts the metal flow.

Often voids or inclusions are caused by small pieces of investment material breaking away from the mold and being carried into the pattern cavity by the liquid metal during pouring. It is believed that the sprue and sprue bases currently in use contribute to damage of the investment mold during removal of the sprue base member from the mold, since it is not possible to remove such sprue bases without creating stresses on the sprue and also on the investment material which is weak and easily damaged. In some situations, part of the total volume of molten metal which is introduced into the pour hole splashes out, thereby reducing the pressure head in the cast tree and increasing the likelihood that the patterns nearest the pour hole do not completely fill with molten metal.

Small grains of metal which are separated from the cast tree are called spatter. In the situation where precious metals are employed, these small spherical grains of metal make inventory control difficult, and reuse of the spattered metal is undesirable since the metal may be contaminated, thereby adding to the cost of the castings. It is believed that when the molten metal stream enters the transition between the sprue button and the sprue in existing sprue designs, small metal spheres bounce out of the sprue button. Additionally, spattered metal may interfere with the operation of the casting machines.

Another difficulty with castings produced using existing sprue designs is the formation of bubbles. These are small spherical additions to the castings caused by air bubbles clinging to the wax tree generated when the investment makes a mold of the bubbles which are subsequently reproduced in metal during casting. For sprues currently in use, these bubbles are caused by air trapped in the sprue button or in the sprue itself released toward the end of the vacuum cycle too late to be removed.

Accordingly, it is an object of the present invention is to provide a casting apparatus which reduces molten metal splash that often occurs in the pouring process and which leads to cold shorts or voids and results in imperfect castings.

Another object of the invention is to provide a casting apparatus for reducing molten metal spatter which results in the loss of precious metals.

Additional objects, advantages and novel features of the invention will be set forth in part in the description which follows, and in part will become apparent to those skilled in the art upon examination of the following or may be learned by practice of the invention. The objects and advantages of the invention may be realized and attained by means of the instrumentalities and combinations particularly pointed out in the appended claims.

SUMMARY OF THE INVENTION

To achieve the foregoing and other objects, and in accordance with the purposes of the present invention, as embodied and broadly described herein, the apparatus for forming a pour hole and main sprue in an investment mold hereof may include: a wax sprue including an elongated upper portion adapted to receive at least one feed sprue, and a flared base; a horizontally disposed base member having a socket formed therein adapted to receive the flared base of the sprue, thereby vertically supporting the sprue, the flared base of the sprue further forming a seal with the base member; and a container having open ends, one open end thereof forming a seal with the base member such that an open-ended flask capable of receiving and containing a liquid introduced into the flask through the other end is formed.

Preferably, the base has a hole therein for venting the socket adapted to receive the flared base of the sprue.

In another embodiment of the present invention, in accordance with its objects and purposes the apparatus for forming a pour hole and main sprue in an investment mold hereof, may include: a wax sprue including an elongated upper portion adapted to receive at least one feed sprue, and a flared base having a hole therein; a rigid, horizontally disposed stand having a finger disposed approximately perpendicular thereto adapted to be received by the hole in the base of the sprue; a base member having a hole therein through which the finger of the stand protrudes, located between the stand and the wax sprue, the flared base of the sprue forming a seal with the base member; and a container having a open ends, one end thereof forming a seal with the base member such that an open-ended flask capable of receiving and containing a liquid introduced into the flask through the other end is formed.

In yet another embodiment of the present invention, in accordance with its objects and purposes the apparatus for forming a pour hole and main sprue in an investment mold hereof, may include: a wax sprue including an elongated upper portion adapted to receive at least one feed sprue, and a flared base having a hole therein; a horizontally disposed base member having a hole therethrough, such that the base member can be fastened to the flared sprue base such that a seal is formed between the base member and the flared sprue base and the sprue is vertically supported; fastening means for fastening the base member to the flared sprue base; and a container having open ends, one end thereof forming a seal with the base member such that an open-ended flask capable of receiving and containing a liquid introduced into the flask through the other end is formed.

Benefits and advantages of the present invention include the ability to make high-quality cast products without bubbles, inclusions and cold shorts, and with minimum spatter, thereby reducing the cost of these products.

BRIEF DESCRIPTION OF THE DRAWINGS

The accompanying drawings, which are incorporated in and form a part of the specification, illustrate three embodiments of the present invention and, together with the description, serve to explain the principles of the invention. In the drawings.

DETAILED DESCRIPTION

Briefly, the present invention includes a sprue having a flared base, a base member adapted to receive the flared base of the sprue for vertically supporting the sprue, and a flask for containing investment material immersing the sprue. Unlike previous investment casting sprue apparatus, the subject invention forms a pour hole in the investment material suitable for smoothly introducing liquid metals into the cavity formed by the sprue in hardened investment material, thereby reducing casting defects which result from turbulence. This is accomplished as a result of the flared base of the sprue, which forms a smooth transition into the sprue itself. The current practice, by contrast, is to use a sprue having a cylindrical base which is simply inserted into a hole in a finger or button formed in the supporting base member for the sprue without regard to a smooth transition. The base member of the present invention is designed to be readily removed from the hardened investment material without damage to the investment material, thereby reducing the number of inclusion defects in the castings. Moreover, repeated use of the base member is possible without significant wear, since sprues may be attached thereto, forming a seal against leakage from the liquid investment material, and the base member removed from the hardened investment material without damaging the sealing surface.

Figure 1:
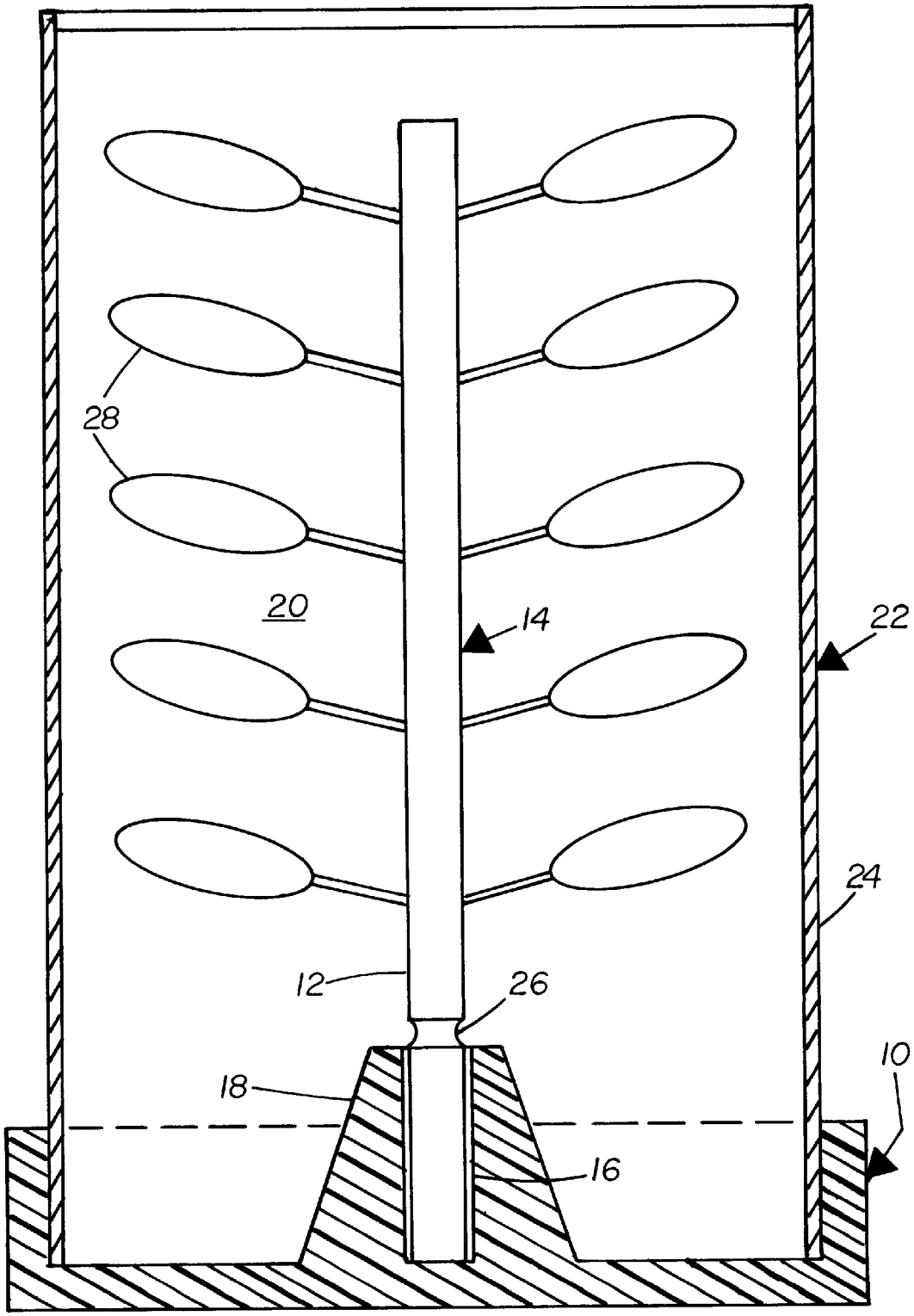
FIG. 1, labeled "Prior Art" is a schematic representation of a typical investment casting apparatus including a sprue having a cylindrical shaft, a base member, and a flask for holding investment material, presently used in the jewelry industry, where the base member has a conical-shaped, vertically disposed finger having a hole therein adapted to receive and hold the cylindrical shaft of the sprue.
Figure 2:
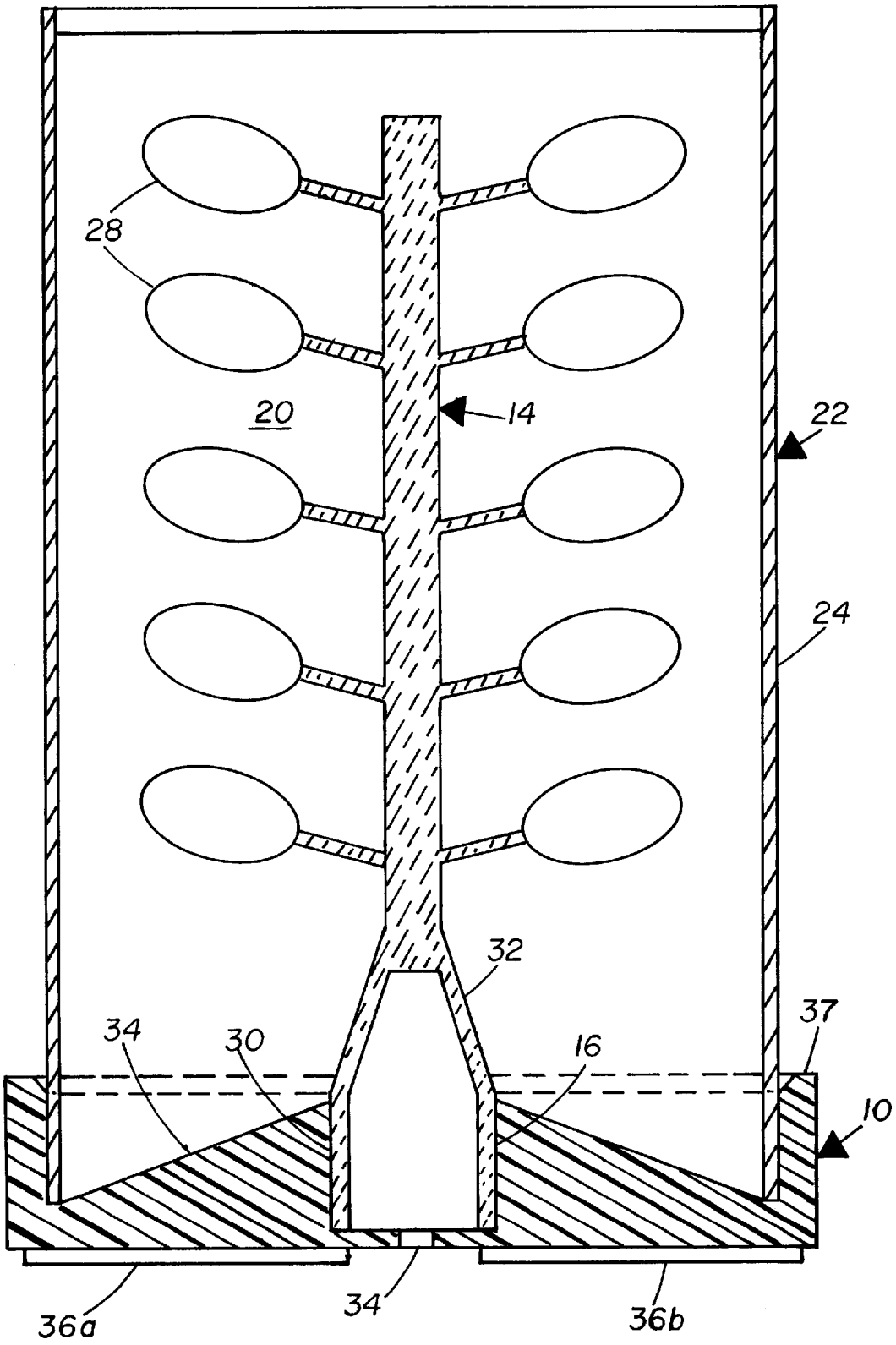
FIG. 2 is a schematic representation of one embodiment of the present invention showing the use of a horizontally disposed, flexible base member having a depression therein adapted to receive and hold the conical-shaped lower shaft of the wax sprue, the depression having hole therein to relieve gas pressure tending to push the sprue away from the base.

Reference will now be made in detail to the present preferred embodiments of the invention examples of which are illustrated in the accompanying drawings. Similar or identical structure is identified using identical callouts. Turning now to the drawings, FIG. 2 is a schematic representation of a cross sectional view of one embodiment of the present invention showing the use of a flexible base member, 10, having a socket, 16, therein adapted to receive and hold the cylindrical portion, 30, of the flared, cylindrical lower shaft, 32, of wax sprue, 14, the socket having hole, 34, therein to relieve gas pressure tending to push the sprue away from the base member. Also shown are the convex inner surface, 36, of the base member in which socket 16 is formed, and three or more radial fins, 36*a*, and 36*b*, on the bottom surface of the base member which permit base member 10 to firmly rest on a flat horizontal supporting surface while permitting gases to escape from hole 34. It should be mentioned that feet which provide stability for the base member and lift it from its supporting horizontal surface may also be employed. The convex inner surface 35 of the base member further extends the smooth transition into the sprue and strengthens the flexible base member which must seal cylindrical flask wall 24 and sprue 14 against leakage of the investment material. Additionally, a bevel is formed in the top rim, 37, of base member 10 which facilitates insertion of flask 24 into base member 10 without damaging patterns 28 attached to sprue 14. Base member 10 may be constructed from elastic materials such as rubber or plastic. When a force is applied to the bottom of the base member in the vicinity of hole 34, socket 16 dilates sufficiently for sprue base 30 to be inserted thereinto forming a seal therewith without significant wear to the socket surfaces or damage to the wax sprue. Moreover, when simultaneous pressure is applied to the bottom of the base member near hole 34 and to top rim 37 thereof, base member 10 is readily removed from flask 24 without exerting stress on the sprue or the hardened investment material. Once base member 10 is removed from the hardened investment, the flared base 32 of sprue 14 (sprue button) forms the pour hole and funnel in the mold which gathers the cast material and smoothly directs it into sprue 14. This transition has been designed to reduce turbulence in the stream as the molten cast material enters the sprue. Sprue 14 provides a conduit to patterns 28 which are the object of the casting, once the wax is removed from the hardened investment material. Sprue 14 can be hollow or solid and its shape may be varied depending on the object to be cast.

Figure 3B:
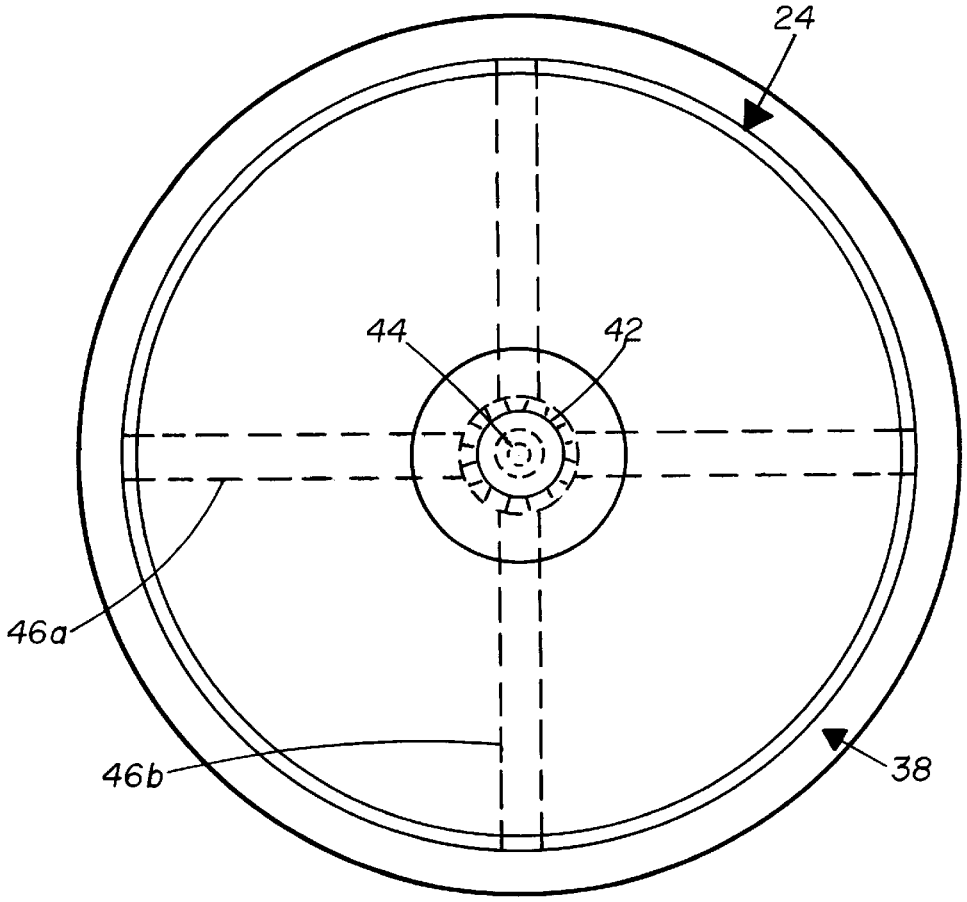
FIGS. 3*a–c* are a schematic representations of a second embodiment of the present invention, FIGS. 3*a* and 3*b* showing a side view and top view, respectively, of the use of a horizontally disposed, rigid stand having a self tapping finger and a rubber or plastic base member supported thereby for providing support and a sealing surface for the sprue, which has a flared lower shaft, shown in FIG. 3*c*, and for the flask for containing investment material.
Figure 3A:
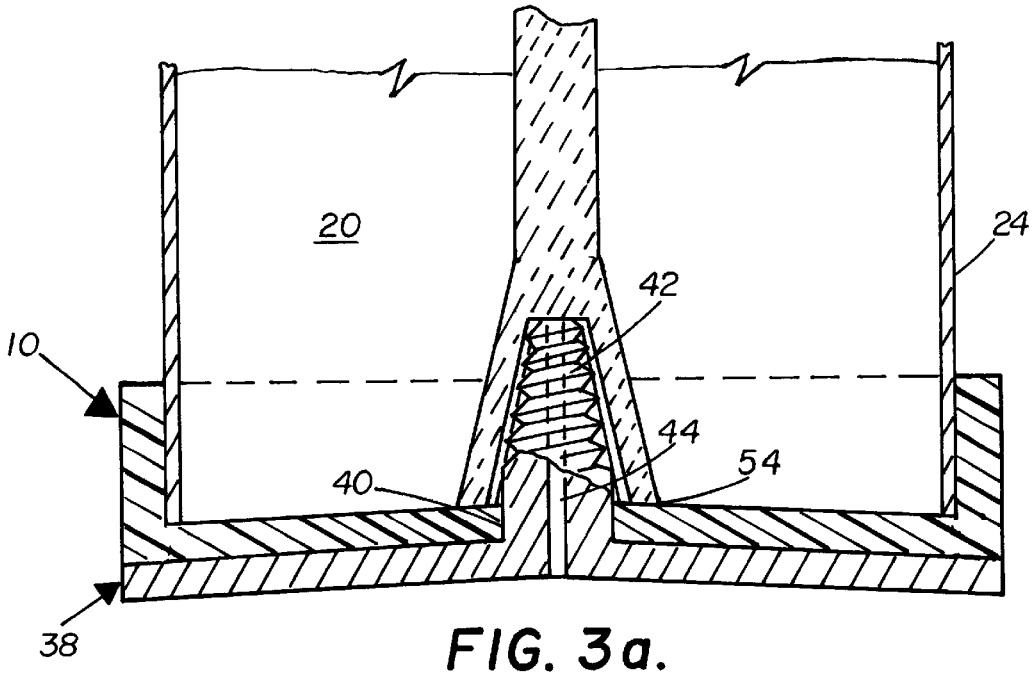
Figure 3C:
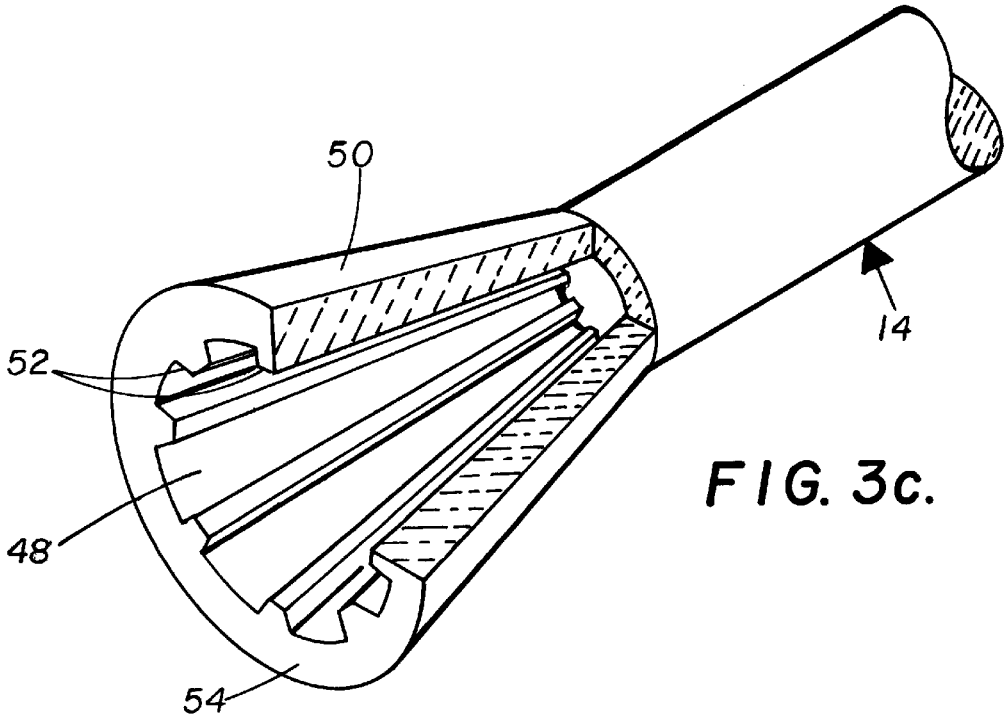

FIG. 3*a* is a schematic representation of a second embodiment of the present invention, showing horizontally disposed rigid stand, 38, which holds base member 10. Base member 10 has a hole, 40, in its center adapted to receive a vertically disposed, tapered and threaded portion, 42, of stand 38, having hole, 44, therein for relieving accumulated gases. A schematic representation of the top view of the apparatus shown in FIG. 3*a* is shown in FIG. 3*b*. The stand is shown having fins, 46*a* and 46*b*, for stabilizing the apparatus on a flat, horizontal supporting surface and for permitting gases to escape from hole 44. Threaded portion 42 is designed for being threaded into tapered hole, 48, in the flared lower portion, 50, of wax sprue 14 shown in FIG. 3*c*. Hole 48 may have a splined inner surface, 52, for more effectively being tapped by threaded portion 42 in stand 38. When sprue 14 is affixed to stand 38 by turning the sprue onto threaded portion 42, a seal is formed between the bottom, 54, of sprue 14 and rubber or plastic base member 10 which prevents leakage of investment material. Again, base 10 seals vertical flask wall 24 for a similar reason. This embodiment of the present invention permits the use of a thinner base member which makes it easier to use and less expensive to fabricate. The attachment of the stand to the screw portion forms a convenient handwheel for readily removing the screw portion from the bottom of the hardened investment material without breaking or otherwise damaging the investment. The rubber or plastic base member can then be easily removed. A good seal between the bottom surface of the sprue and the rubber or plastic base member is also formed. Since the surface of the base member which mates with the bottom of the sprue is flat, and the sprue material is wax, there is virtually no wear at the sealing surfaces. Since the wax is used once in lost wax casting, a new sealing edge is effectively formed with subsequent sprues. The use of a screw and a splined sprue hole has been found to allow the screw to tighten the flared wax base of the sprue sufficiently to depress the rubber without splitting or breaking the wax. Additionally the venting screw in the hole prevents significant forces from breaking this seal. It has also been observed that turbulence is so reduced when liquid metal is introduced into the hardened investment material for this embodiment, that a significant reduction in the number of defects in the castings results. Moreover, the number of inclusion defects resulting from investment material entering the castings is likewise reduced.

Figure 4:
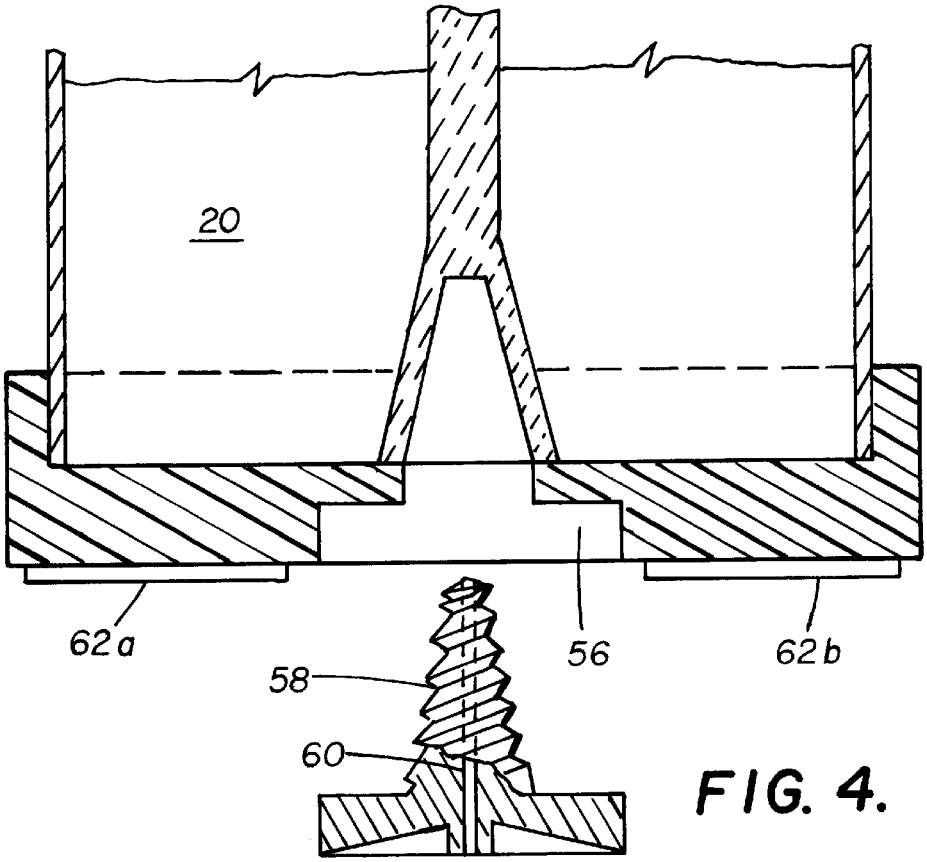
FIG. 4 is a schematic representation of a third embodiment of the invention showing the use of a more horizontally disposed, somewhat more rigid base member without a stand and having a separable sprue fastening means for providing support and a sealing surface for the sprue, which has a flared lower shaft, and for the flask containing investment material.

FIG. 4 is a schematic representation of a third embodiment of the present invention, showing a side view of base member 10 which has a countersunk hole, 56, therein adapted to receive tapered, threaded screw, 58. In a similar manner to that in which the vertically disposed threaded screw of stand 38 of FIG. 3*a* engages the tapered hole 48 of sprue 14 shown in FIG. 3*c*, screw 58 attaches sprue 14 to base 10 forming a seal between the bottom 54 of the sprue and rubber or plastic base member 10, thereby vertically supporting sprue 14. Threaded screw 58 is also provided with hole, 60, therein for venting trapped gases. Shown in FIG. 4 are fins, 62*a* and 62*b*, on the lower portion of base member 10 for stabilizing the base on a flat, horizontal supporting surface and for permitting vented gases to escape from hole 60.

The foregoing description of the invention has been presented for purposes of illustration and description and is not intended to be exhaustive or to limit the invention to the precise form disclosed, and obviously many modifications and variations are possible in light of the above teaching.

The embodiments were chosen and described in order to best explain the principles of the invention and its practical application to thereby enable others skilled in the art to best utilize the invention in various embodiments and with various modifications as are suited to the particular use contemplated. It is intended that the scope of the invention be defined by the claims appended hereto.

What is claimed is:

1. An apparatus for forming a pour hole and main sprue in an investment mold, which comprises in combination:

(a) a wax sprue comprising:

(i) an elongated upper portion capable of receiving at least one feed sprue; and (ii) a flared base;

(b) a horizontally disposed base member having a socket therein capable of receiving the flared base of said sprue, thereby vertically supporting said sprue, the flared base of said sprue further forming a seal with said base member; and (c) a container having a first open end and a second open end, the first open end thereof forming a seal with said base member such that an open-ended flask capable of receiving and containing a liquid introduced into said flask through the second end is formed.

2. The apparatus for forming a pour hole and main sprue in an investment mold as described in claim 1, wherein the flared base of said sprue has a hollow portion therein.

3. The apparatus for forming a pour hole and main sprue in an investment mold as described in claim 1, wherein said base member has a hole therein in the socket for receiving the flared base of said sprue, for venting the socket.

4. The apparatus for forming a pour hole and main sprue in an investment mold as described in claim 1, wherein said base member is fabricated from materials selected from the group consisting of rubber and plastic.

* * * * *